US005599125A

United States Patent [19]

Vasas et al.

[11] Patent Number: 5,599,125

[45] Date of Patent: Feb. 4, 1997

[54] LIQUID COSMETICS CONTAINER WITH THIN EDGE SEMI-RIGID WIPER

[75] Inventors: Martin M. Vasas, Fairfield; Robert C. Hagemeister, Westbrook, both of Conn.

[73] Assignee: The Bridgeport Metal Goods Manufacturing Company, Bridgeport, Conn.

[21] Appl. No.: 382,139

[22] Filed: Feb. 1, 1995

[51] Int. Cl.[6] ..... A45D 40/00

[52] U.S. Cl. ..... 401/122; 401/129

[58] Field of Search ..... 401/122, 129; 132/218

[56] References Cited

U.S. PATENT DOCUMENTS

| | | | |
|---|---|---|---|
| 565,328 | 8/1896 | Buhler | 401/122 |
| 2,703,898 | 3/1955 | Kellett | 401/122 X |
| 3,146,806 | 9/1964 | Ginsburg | 401/122 X |
| 3,549,266 | 12/1970 | Vasas | 401/122 |
| 3,554,657 | 1/1971 | Aston | 401/122 |
| 3,861,810 | 1/1975 | Vasas | 401/122 |
| 3,883,254 | 5/1975 | Vasas | 401/122 |
| 3,891,330 | 6/1975 | Vasas | 401/122 |
| 3,930,280 | 1/1976 | Vasas | 401/122 X |
| 4,332,494 | 6/1982 | Kingsford | 401/122 X |
| 4,617,948 | 10/1986 | Gueret | 401/122 X |
| 4,671,689 | 6/1987 | Gueret | 132/218 X |
| 4,784,505 | 11/1988 | Dahm | 401/122 |
| 4,886,387 | 12/1989 | Goldberg et al. | 401/122 |
| 5,097,853 | 3/1992 | Nehashi | 132/218 X |

FOREIGN PATENT DOCUMENTS

| | | | |
|---|---|---|---|
| 1070381 | 2/1954 | France | 401/122 |
| 3542474 | 5/1987 | Germany | 132/218 |
| 2106376 | 4/1983 | United Kingdom | 401/122 |

OTHER PUBLICATIONS

BMG Drawing 06760–00C Mar. 26, 1987.
BMG Drawing 07064–00C Mar. 28, 1990.
BMG Drawing 07207–00C Mar. 17, 1992.
BMG Drawing 07212–00E Mar. 20, 1992.

*Primary Examiner*—Steven A. Bratlie
*Attorney, Agent, or Firm*—Parmelee, Bollinger & Bramblett; James R. Frederick

[57] ABSTRACT

A cosmetics container has a bottle, a neck insert defining an entry opening and a wiper diaphragm mounted at the lower end of the entry opening. A cap has an applicator rod and applicator extending therefrom, for insertion into the bottle and withdrawal from the bottle with cosmetics. The wiper diaphragm defines a wiper orifice, and has a conical descending upper surface and a concave lower surface converging with the upper surface to create a thin edge peripherally surrounding the wiper orifice. The wiper diaphragm is fabricated of semi-rigid plastic which stretches and flexes to accommodate and seal to the applicator rod and which is rigid with respect to the applicator for wiping it. The concave lower surface conducts wiped cosmetics away from the orifice. The bottle includes a plastic liner. A modified wiper includes a radially segmented spill cover deployed across the wiper orifice, to prevent cosmetics from running from the bottle if it is tipped over while the cap is off.

19 Claims, 3 Drawing Sheets

LIQUID COSMETICS CONTAINER WITH THIN EDGE SEMI-RIGID WIPER

FIELD OF THE INVENTION

The invention herein relates to a cosmetics container for liquid cosmetics, such as mascara, including a thin edge semi-rigid wiper.

BACKGROUND OF THE INVENTION

Mascara and other liquid cosmetics are packaged in a bottle having a cap and applicator. The applicator is typically a brush mounted at the end of an applicator rod, with the cap of the bottle providing a handle for the applicator. Other applicators include threaded rods and foam or fabric pads, the latter being particularly useful with other liquid cosmetics, such as perfumes.

The applicator is inserted through the neck of the bottle in order to install the cap and recharge the applicator with cosmetics, and a wiper is provided at the entry opening to the bottle. The wiper functions to control the amount of cosmetics removed from the bottle on the applicator, and also seals against the applicator rod to maintain the cosmetics in the lower part of the bottle.

Many variations of wipers have been used. These include wipers fabricated of buna rubber or neoprene, which are highly flexible and stretchable. Therefore, such wipers provide an excellent sealing function and are well adapted to the wiping function as well; however, the material costs and cost of fabrication are relatively high for this type of wiper. Other wipers have been molded of less expensive low density polyethylene, providing an essentially rigid wiper structure defining a wiper orifice of desired size. Although less expensive, these wipers have generally not achieved good sealing, and are particularly sensitive to tolerance variations in the applicator rod.

Lastly, all wipers experience some difficulty with a buildup of thicker cosmetics, such as mascara, on their under side, where cosmetics accumulate as they are wiped from the applicator as the applicator is removed from the bottle. Improvement in this aspect of cosmetics containers would be desirable. Another difficulty with thinner liquid cosmetics such as perfume is a tendency to run out of the container through the wiper, if the container is spilled when the applicator rod is out.

SUMMARY OF INVENTION

It is a principal object of the invention herein to provide a cosmetics container including an efficient wiper.

It is an additional object of the invention to provide a wiper for a cosmetics container which achieves a good seal with the applicator rod.

It is a further object of the invention herein to provide a wiper for a cosmetics container with good control of the amount of cosmetics carried by the applicator.

It is another object of the invention herein to provide a wiper for a cosmetics container which avoids a buildup of cosmetics on the under side thereof.

It is also an object of the invention herein to provide a cosmetics container including an efficient wiper and a liner for containing cosmetics.

It is a still further object of the invention to provide a wiper which minimizes spills of thin liquid cosmetics.

It is yet another object of the invention to provide a wiper for a cosmetics container which is low in cost.

A cosmetics container according to the invention herein comprises a cap having a rod extending therefrom and an applicator secured to the end of the rod, and a bottle having a sidewall and a bottom wall for containing liquid cosmetics and an open upper end. A neck assembly includes a bottle insert mounted in the upper end of the bottle with a threaded neck extending above the bottle for accepting the cap, the bottle insert defining an axial entry opening to the bottle and cosmetics stored therein. The entry opening has a diameter sized to provide substantially no wiping action on the applicator. A wiper diaphragm is mounted at the lower end of the bottle insert and defines a wiper orifice sized to seal against and wipe the applicator rod and to wipe the applicator. The wiper diaphragm has a generally conical shape extending into the bottle, with upper and lower surfaces converging at the wiper orifice to create a thin edge peripherally surrounding the wiper orifice. The wiper diaphragm is fabricated of semi-rigid plastic which provide for flexure to achieve good sealing contact with the applicator rod, but rigidity with respect to the applicator for good wiping action.

According to one aspect of the invention, the lower surface of the wiper diaphragm is provided in a concave curved configuration from the thin edge of the wiper orifice to the bottle wall, for conducting wiped mascara away from the wiper orifice to return it the general supply of cosmetics.

According to another aspect of the invention, the bottle is provided with a plastic body insert extending downwardly from the bottle insert and wiper diaphragm, wherein the bottle insert contains the cosmetics within the bottle.

According to an additional aspect of the invention, reflectable petalloids are deployed in the wiper orifice and substantially cover the orifice upon removal of the applicator rod, to minimize spillage. The applicator rod may be smaller than a wiper orifice according to this aspect of the invention.

Other features and objects of the invention will appear in the following description of the preferred embodiments and the claims, taken in connection with the accompanying drawings.

DRAWINGS

The same reference numerals refer to the same elements throughout the various figures.

DESCRIPTION OF PREFERRED EMBODIMENT

Figure 1:
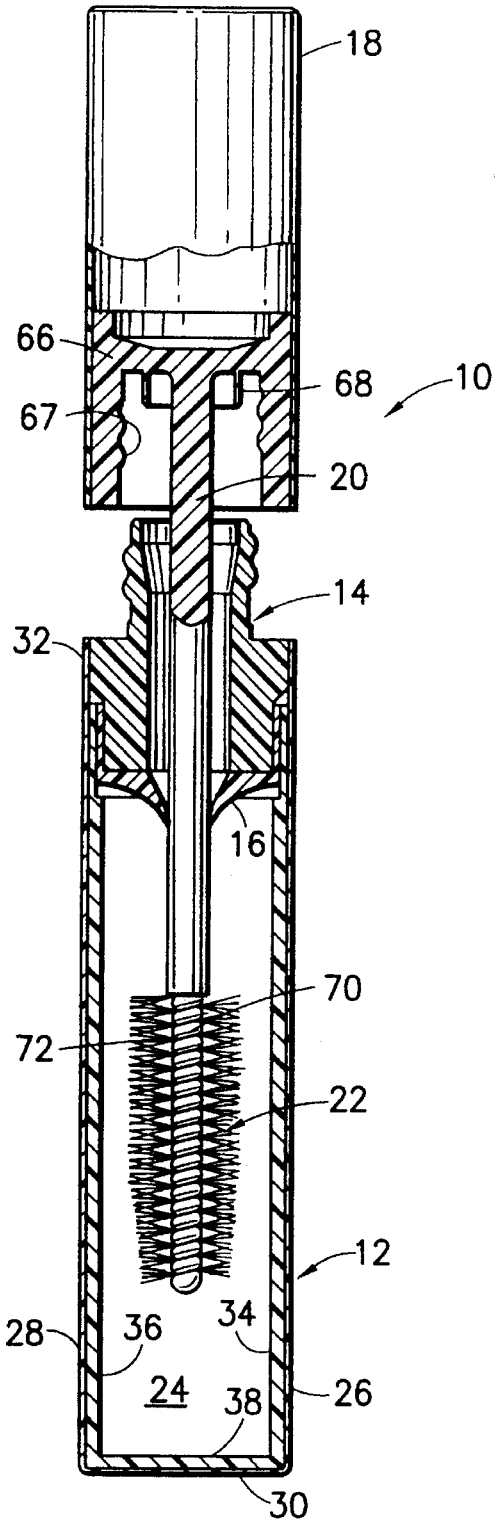
FIG. 1 is a longitudinal view, mostly in section, of a cosmetics container according to the invention herein.

A cosmetics container 10 according to the invention herein generally comprises a bottle 12, a neck assembly 14 including a wiper diaphragm 16, and a cap 18 mounting an applicator rod 20 and applicator 22. The bottle 12 and neck assembly 14 define a chamber 24 for receiving and storing cosmetics, which are transferred to the applicator and the applicator removed from the bottle for applying the cosmetics.

The bottle 12 includes a cylindrical outer shell 26 having a cylindrical sidewall 28 and a bottom wall 30. The shell 26 has an upper end 32 which receives the neck assembly 14, as more fully described below. The outer shell 26 is preferably fabricated of metal, and may be polished, lacquered, embossed, and the like to provide decoration consistent with the appearance of a cosmetics container.

Figure 3:
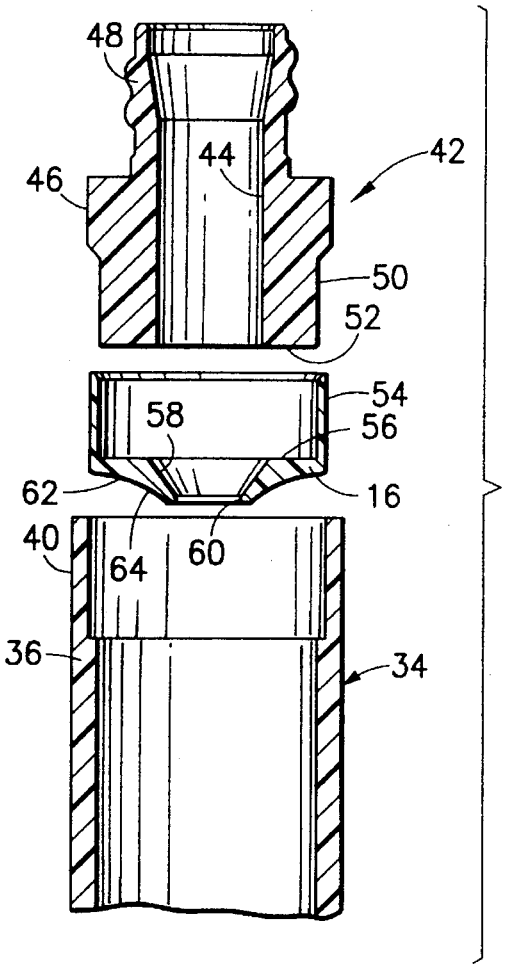
FIG. 3 is an exploded view of the upper portion of the bottle, and wiper assembly of the cosmetics container of FIG. 1.

The bottle 12 is provided with a liner 34 having a cylindrical sidewall 36 closely received in the cylindrical sidewall 28 of the shell 26 and a bottom wall 38 adjacent the bottom wall 30 of the shell. As best seen in FIG. 3, the upper portion 40 of the liner sidewall 36 is of reduced thickness. The liner 34 is shorter than the outer shell 26, wherein the upper end 32 of the outer shell 36 is not covered by the liner 34. The liner is fabricated of low density polyethylene, and other plastics are also suitable.

The neck assembly 14 includes a bottle insert 42 which, in this preferred embodiment, is metal. The bottle insert is generally tubular, and defines an entry opening 44 to the cosmetics chamber 24 within the bottle 12. An annular flange 46 is provided generally medially the bottle insert 42, the flange 46 being sized for press fit into the upper end 32 of the outer shell 26, above the liner 34. The upper portion of the bottle insert 42 is a threaded neck 48 of the bottle, and the lower end of the bottle insert is a shank 50 for receiving the wiper diaphragm 16 and the upper end 40 of the liner 34. The shank 50 has a flat annular bottom surface 52, which surrounds the entry opening 44.

Figure 2:
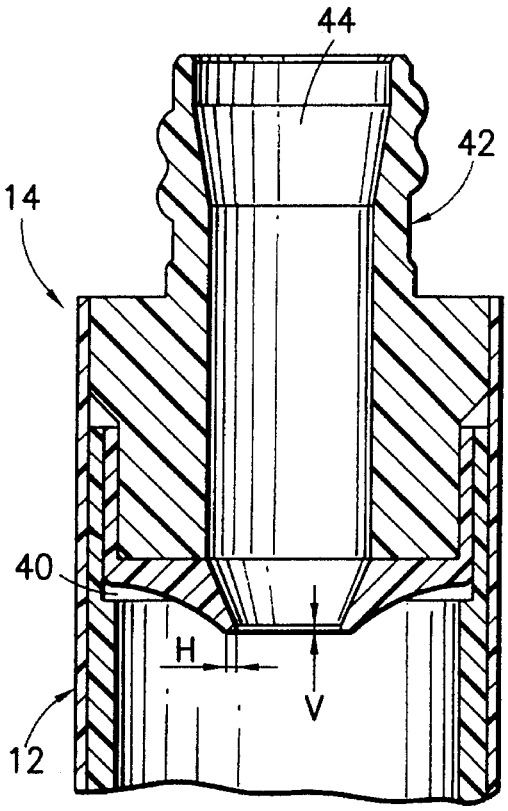
FIG. 2 is an enlarged sectional view of the upper portion of the bottle and the neck assembly of the cosmetics container of FIG. 1.

The wiper diaphragm 16 is provided with a mounting sleeve 54 extending upwardly therefrom and the wiper diaphragm 16 has a flat upper annular surface 56 commensurate with the annular bottom 52 of the shank 50, whereby the sleeve 54 and surface 56 adapt the wiper diaphragm for mounting on the shank 50. The upper wiping surface 58 of the wiper diaphragm 16 is conical and descends downwardly toward the bottom of bottle 12 and chamber 24 defined therein, the upper wiping surface 58 terminating at a wiper orifice 60 defined centrally in the wiper diaphragm 16. The lower wiping surface 62 of the wiper diaphragm 16 is concave, and flairs downwardly from the outside periphery of the wiper diaphragm to the wiper orifice 60. The upper wiping surface 58 and lower wiping surface 62 converge at the wiper orifice 60 to create a thin edge 64 surrounding and defining the wiper orifice 60. The wiper diaphragm 16 is fabricated of low density polyethylene, and the dimensions V and H of the thin edge 64 in both the vertical and horizontal axes are in the range of approximately 0.015 inch or less, and preferably on the order of 0.010 inch or less, as best seen in FIG. 2. The horizontal dimension H is a substantially flat annular surface in the horizontal plane, and the vertical surface V is the vertical height of the wiper at the wiper orifice. The intersection of these surfaces is rounded.

For assembly purposes, the mounting sleeve 54 and upper end 40 of the liner 34 are received on the shank 50 of the bottle insert 42, and the neck assembly 14 is then inserted into the outer shell 26 until the flange 46 of the body insert is press fit into the upper end 32 of the shell 26. The dimensions of the shank 50, mounting sleeve 54 and upper end 40 of the liner 34 are selected such that they are all compressed against the outer shell 26 in a sealing manner.

The cap 18 is a closed end tubular metal shell having the base 66 of applicator rod 20 pressed therein, and the base 66 preferably extends to the lower end of the cap and is interiorly threaded at 67 for securing the cap on the threaded neck 48 of the bottle insert. The base 66 may also include a thin tubular inner wall 68 which fits inside the threaded neck 48, for secure sealing between the neck and cap.

The applicator rod 20 extends through the entry opening 44 and wiper orifice 60, and has the applicator 22 mounted on the end thereof. The applicator 22 is a brush having a twisted wire stem 70 and bristles 72. The stem 70 is inserted into the end of the applicator rod 20 for mounting the applicator thereto.

The applicator rod 20 is of slightly greater diameter, on the order of 0.002–0.008 inches, than the wiper orifice 60, wherein the wiper orifice 60 is flexed and stretched open when the applicator rod 20 is inserted therethrough. The thin edge 64 is sufficiently flexible to stretch and accommodate the larger diameter of the applicator rod, to maintain a good seal thereto, and to wipe cosmetics from the applicator rod as it is removed from the cosmetics chamber 24. In this regard, when the wiper orifice 60 is stretched to a larger diameter, it increases the downward inclination of the lower surface 62 of the wiper diaphragm, which further improves the scraping action.

The downward inclination and concavity of the wiping lower surface 62 of the wiper diaphragm also serve to direct cosmetics wiped from the applicator rod away from the applicator rod and wiper orifice, toward the sidewalls of the bottle, for returning the wiped cosmetics to the rest of the cosmetics stored in the chamber 24.

The thin edge of the wiper diaphragm 24 is essentially rigid with respect to a brush or other soft applicator, and also achieves good wiping action with respect to the applicator 22, and disperses wiped cosmetics therefrom.

The wiper diaphragm 14 is fabricated of low density polyethylene, which is readily moldable to the shape and dimensions described, including the thin edge 64 surrounding the wiper orifice 60. The low density polyethylene also has flexural characteristics such that the wiper can stretch to accommodate a slightly larger diameter applicator rod.

Figure 4:
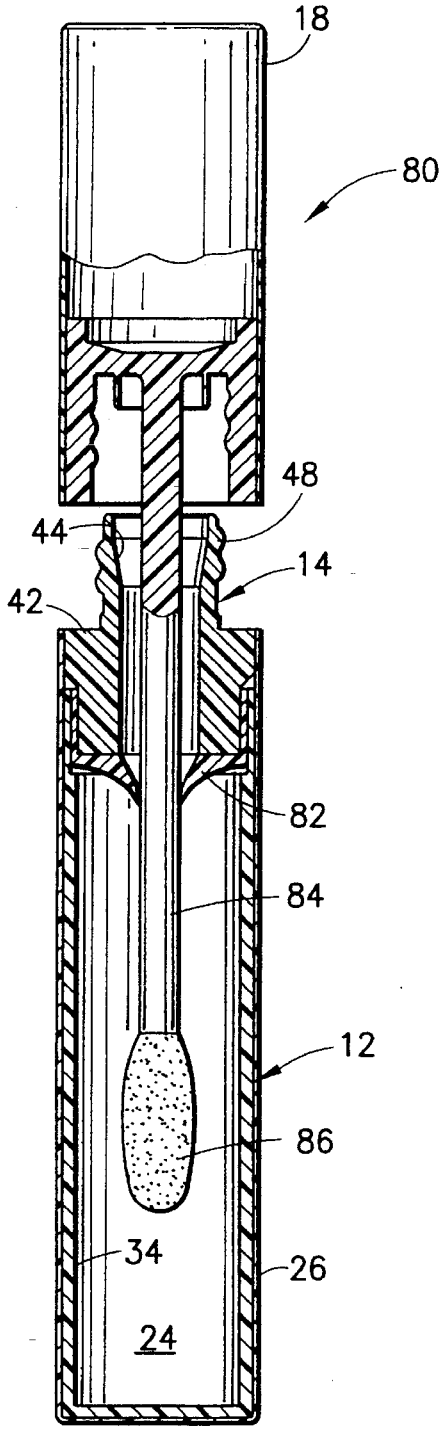
FIG. 4 is a longitudinal view, mostly in section, of another cosmetics container according to the invention herein.
Figure 5:
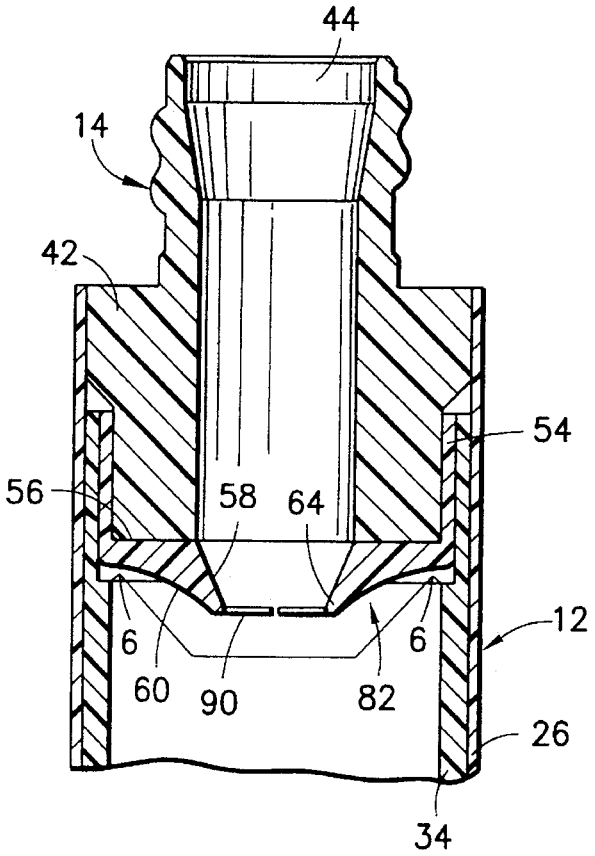
FIG. 5 is an enlarged sectional view of the upper portion of the bottle and the neck assembly of the cosmetics container of FIG. 4.
Figure 6:
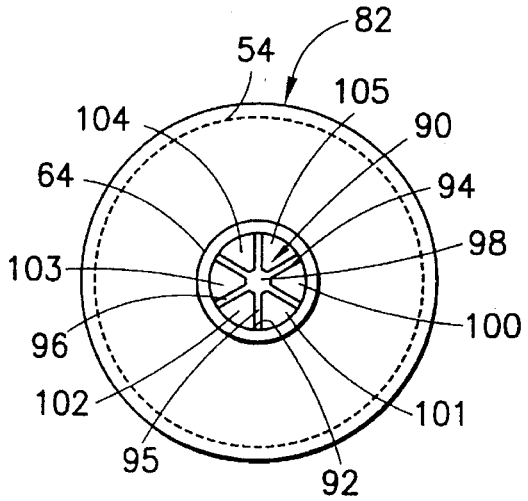
FIG. 6 is a plan view of the wiper of the cosmetics container of FIG. 4, taken along the lines 6—6 of FIG. 5.

The cosmetics container 10 is used by removing the cap 18 from the threaded neck and withdrawing the applicator and applicator rod. This wipes excess cosmetics from the applicator rod and applicator, leaving the desired amount for use. Additional cosmetics may be obtained by inserting the applicator into the bottle and withdrawing it, achieving the same wiping action. After application, the applicator and applicator rod are inserted through the wiper diaphragm and the cap 18 is threaded onto neck 48 of the bottle insert 42. The wiper diaphragm achieves a good seal against the applicator rod, maintaining cosmetics within the chamber FIGS. 4–6 illustrate a cosmetics container 80 according to the invention herein, which is especially well adapted for dispensing perfume. The cosmetics container 80 is made of the same parts as the cosmetics container 10 described above, with the exception of the wiper 82, applicator rod 84 and applicator 86. The applicator 86 is a thermoplastic flexor and can also be provided as a fabric pad.

The wiper diaphragm 82 is the same as the wiper diaphragm 16, with the addition of a radially segmented spill cover 90. More particularly, the wiper diaphragm 82 has a mounting sleeve 54 and a mounting surface 56 which seats on the under side of the bottle insert 42. The wiper diaphragm 82 further includes a generally conical upper wiping surface 58, and a lower wiping surface 60 which converge to define an annular thin edge 64 defining an orifice 92. The spill cover 90 is deployed in the orifice 92.

With particular reference to FIG. 6, the spill cover 90 is separated by three diametric slits 94, 95 and 96 passing through center 90, resulting in six radially segmented, pie-shaped segments 100–105 extending inwardly from the thin edge 64. The spill cover is preferably thin and flexible, on the order of 0.015 inches and preferably 0.010 inches or less, i.e., the same thickness as the vertical dimension of the thin edge.

The slits 94–96 are preferably not formed through the spill cover 90 at the time of manufacture. Thus, the spill cover can be used as a moisture and vapor seal prior to insertion of the applicator 86 and applicator rod. This provides the option of protecting volatile cosmetics against evaporation prior to first use. The slits are easily broken away upon the first insertion of the applicator and applicator rod, to separate the spill cover into segments 100–105.

In the embodiment shown, the applicator rod 84 of cosmetics container 80 is of slightly smaller diameter than the wiper orifice 92. The wiper diaphragm still seals against the rod, by means of the proximity of the thin edge and the folded segments. If a tighter seal is desired against the applicator rod, a larger diameter applicator rod can be utilized. Further, because the cosmetics container 80 including the modified wiper 82 is used in conjunction with thinner cosmetics, such as perfume, the scraping function of the wiper as necessary is not, although the wiper 82 does serve to remove excess, dripping quantities of perfume from the applicator 86.

The cosmetics container 80 is particularly useful in controlling spills. After the applicator and applicator rod are removed for applying perfume, the segments 100–105 substantially cover the orifice 92, such that if the cosmetics container 82 is tipped on its side, at most a small quantity of the perfume escapes. Therefore, the wiper diaphragm 82 provides sealing, adequate wiping, and spill control in a cosmetics container.

The wiper diaphragm 82 is also preferably fabricated of low density polyethylene, or of another plastic material having similar properties of semi-rigidity and flexibility in thin portions.

Accordingly, the preferred embodiments described above admirably achieve the objects of the invention herein. It will be appreciated by those skilled in the art that various changes may be made in the preferred embodiments without departing from the spirit and scope of the invention, which is defined by the following claims.

We claim:

1. A wiper diaphragm for use in a cosmetics container of the type comprising a bottle including a bottle neck defining an entry opening, a cap and an applicator rod extending from the cap and mounting an applicator on the distal end thereof, the applicator and applicator rod being inserted through the entry opening as the cap is placed on the neck to close the container and the applicator and applicator rod being withdrawn from the neck to remove cosmetics from the bottle, the wiper diaphragm being mounted extending across the entry opening and defining a wiper orifice sized to accept and seal to the applicator and wipe the applicator mounted thereto, the wiper diaphragm having an upper conical surface and a lower surface converging with the upper surface at the wiper orifice to define a thin edge peripherally surrounding and defining the wiper orifice, the thin edge having a vertical surface with a dimension of about 0.015 inches or less, the wiper diaphragm being fabricated of semi-rigid plastic material the thin edge of which flexes and stretches with respect to the applicator rod to achieve good sealing therewith, the thin edge being rigid with respect to the applicator for fixed thin edge wiping action with respect thereto.

2. A wiper diaphragm as defined in claim 1 wherein the upper surface of the wiper diaphragm is conical and descends into the bottle.

3. A wiper diaphragm as defined in claim 2 wherein the lower surface of the wiper diaphragm is concave and flairs from the wiper orifice and is maintained concave and flared by the rigidity of the wiper as the applicator is withdrawn from the cosmetics container for conducting wiped cosmetics away from the rod and applicator.

4. A wiper diaphragm as defined in claim 1 wherein the wiper diaphragm is mounted across the lower end of the entry opening.

5. A wiper diaphragm as defined in claim 4 wherein the upper surface of the wiper diaphragm is conical and descends into the bottle and the lower surface of the wiper diaphragm is concave and flairs from the wiper orifice and is maintained concave and flared by the rigidity of the wiper as the applicator is withdrawn from the cosmetics container for conducting wiped cosmetics away from the rod and applicator.

6. A wiper diaphragm as defined in claim 5 and fabricated of low density polyethylene.

7. A wiper diaphragm as defined in claim 1 and fabricated of low density polyethylene.

8. A wiper diaphragm as defined in claim 1 and further comprising a radially segmented spill cover deployed across the wiper orifice from the thin edge of the wiper diaphragm.

9. A wiper diaphragm as defined in claim 8 wherein the spill cover is comprised of six radially extending segments having a thickness no greater than the thin edge of the wiper diaphragm.

10. A wiper diaphragm as defined in claim 1 wherein the vertical surface of the thin edge has a dimension of about 0.010 inches or less.

11. A wiper diaphragm as defined in claim 1 wherein the thin edge has a horizontal surface with a dimension of about 0.015 inches or less, and the intersection of the vertical and horizontal surfaces is rounded.

12. A cosmetics container for storing and applying liquid cosmetics, the container comprising:

A) a cap having an applicator rod extending therefrom and an applicator brush having radially extending bristles secured to the distal end of the applicator rod with the bristles extending radially outwardly beyond the applicator rod;

B) a bottle having a cylindrical inner sidewall and a bottom wall for containing liquid cosmetics, and an open upper end;

C) a neck assembly including:

1) a bottle insert mounted in the open upper end of the bottle, the bottle insert including a threaded neck extending above the bottle for accepting the cap, and the bottle insert defining an entry opening to the bottle and cosmetics contained therein, the entry opening having a diameter sized to provide substantially no wiping action on the applicator, and 2) a wiper diaphragm fabricated of semi-rigid plastic and mounted to the lower end of the bottle insert and defining a wiper orifice sized to seal against and wipe the applicator rod and to wipe the applicator brush, the wiper diaphragm having a conical upper surface descending downwardly toward the interior of the bottle and a lower surface converging with the upper surface to create a thin edge peripherally surrounding the wiper orifice and flexible with respect to the applicator rod and rigid with respect to the applicator brush as the applicator brush is inserted and withdrawn, the lower surface being concave and flared from the wiper orifice toward the inner sidewall of the bottle for conducting wiped cosmetics away from the rod applicator toward the sidewall of the bottle as the rod and applicator are withdrawn from the container.

13. A cosmetics container as defined in claim 12 wherein the wiper diaphragm has a cylindrical mounting sleeve extending upwardly from the outer periphery thereof, and the bottle insert has a reduced diameter shank receiving the mounting sleeve for mounting the wiper diaphragm at the lower end of the entry opening defined by the bottle insert.

14. A cosmetics container as defined in claim 13 and further comprising a bottle liner having a cylindrical sidewall closely received by the cylindrical sidewall of the bottle, a bottom wall, and an open upper end, the upper end of the liner being received on the shank of the bottle insert surrounding the sleeve of the wiper diaphragm.

15. A cosmetics container as defined in claim 14 wherein the wiper diaphragm and liner are fabricated of low density polyethylene.

16. A wiper diaphragm as defined in claim 12 and further comprising a radially segmented spill cover deployed across the wiper orifice from the thin edge of the wiper diaphragm.

17. A wiper diaphragm as defined in claim 16 wherein the spill cover is comprised of six radially extending segments having a thickness no greater than the thin edge of the wiper diaphragm.

18. A wiper diaphragm as defined in claim 12 wherein the thin edge has a vertical surface with a dimension of about 0.015 inches or less.

19. A wiper diaphragm as defined in claim 18 wherein the thin edge has a horizontal surface with a dimension of about 0.015 inches or less, and the intersection of the vertical and horizontal surfaces is rounded.

* * * * *